US009670601B2

(12) United States Patent
Schäffler et al.

(10) Patent No.: US 9,670,601 B2
(45) **Date of Patent: *Jun. 6, 2017**

(54) AIR JET SPINNING MACHINE AND METHOD FOR OPERATING THE SAME

(71) Applicant: Maschinenfabrik Rieter AG, Winterthur (CH)

(72) Inventors: Gernot Schäffler, Wäschenbeuren (DE); Jörg Hehl, Leinfelden (DE); Andreas Fischer, Steckborn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/737,737

(22) Filed: Jun. 12, 2015

(65) Prior Publication Data

US 2015/0361592 A1 Dec. 17, 2015

(30) Foreign Application Priority Data

Jun. 12, 2014 (CH) ..... 00889/14

(51) Int. Cl.
*D01H 4/02* (2006.01)
*D01H 13/32* (2006.01)
(Continued)

(52) U.S. Cl.
CPC ..... *D01H 4/02* (2013.01); *D01H 1/115* (2013.01); *D01H 13/22* (2013.01); *D01H 13/306* (2013.01); *D01H 13/32* (2013.01)

(58) Field of Classification Search
CPC ..... D01H 4/02; D01H 1/115; D01H 13/22; D01H 13/306; D01H 13/32
See application file for complete search history.

(56) References Cited

U.S. PATENT DOCUMENTS 5,421,529 A * 6/1995 Hans ..... B65H 63/0322 15/214
6,571,620 B2 * 6/2003 Moisio ..... G01B 21/06 73/159
(Continued)

FOREIGN PATENT DOCUMENTS

DE 4026191 A1 2/1992
EP 1 249 682 A1 10/2002
(Continued)

OTHER PUBLICATIONS

Swiss Patent Office Search Report, dated Sep. 5, 2014.
EP Search Report, Apr. 18, 2016.

*Primary Examiner* — Shaun R Hurley
(74) *Attorney, Agent, or Firm* — Dority & Manning, P.A.

(57) ABSTRACT

A method for operating an air jet spinning machine having at least one spinning unit with one spinning nozzle for producing a yarn is provided. During the operation of the spinning unit, the spinning nozzle feeds a fiber composite through an inlet in a predefined transport direction. The fiber composite within a vortex chamber of the spinning nozzle receives a twist with the assistance of a vortex air flow, such that a yarn is formed from the fiber composite. With the assistance of at least one sensor system, the yarn leaving the outlet is monitored with regard to defined yarn flaws. The production of yarn is interrupted upon the detection of a corresponding yarn flaw. Between the detection of the specified yarn flaw and the interruption of the yarn production, a cleaning process is carried out during which an additive is fed to the spinning unit and is applied to the fiber composite and/or the yarn produced from the fiber composite and/or on parts of the spinning nozzle.

12 Claims, 4 Drawing Sheets

(51) Int. Cl.

| | |
|---|---|
| ***D01H 1/115*** | (2006.01) |
| ***D01H 13/22*** | (2006.01) |
| ***D01H 13/30*** | (2006.01) |

(56) References Cited

U.S. PATENT DOCUMENTS

| | | | | |
|---|---|---|---|---|
| 2013/0067880 | A1 | 3/2013 | Stephan et al. | |
| 2014/0283496 | A1* | 9/2014 | Stahlecker | D01H 4/48 57/263 |
| 2015/0283746 | A1* | 10/2015 | Schaffler | B29C 47/0014 425/319 |
| 2015/0283747 | A1* | 10/2015 | Hofmann | B29C 47/0014 425/319 |
| 2015/0284878 | A1* | 10/2015 | Kubler | D01D 5/06 425/461 |
| 2015/0361594 | A1* | 12/2015 | Fischer | D01H 13/32 53/296 |

FOREIGN PATENT DOCUMENTS

| | | | |
|---|---|---|---|
| EP | 2 302 114 | A2 | 3/2011 |
| EP | 2 450 478 | A2 | 5/2012 |
| EP | 2 573 238 | | 3/2013 |
| EP | 2620532 | A1 | 7/2013 |
| JP | 2013160678 | A | 8/2013 |

* cited by examiner

AIR JET SPINNING MACHINE AND METHOD FOR OPERATING THE SAME

FIELD OF THE INVENTION

The present invention relates to a method for operating an air jet spinning machine, whereas the air jet spinning machine features at least one spinning unit with one spinning nozzle for producing a yarn, whereas, during the operation of the spinning unit, a fiber composite is fed to the spinning nozzle through an inlet and in a predefined transport direction, whereas the fiber composite within a vortex chamber of the spinning nozzle receives a twist with the assistance of a vortex air flow, such that a yarn is formed from the fiber composite, and ultimately leaves the spinning nozzle through an outlet. With the assistance of at least one sensor system, the yarn leaving the outlet is monitored with regard to defined yarn flaws, and whereas the production of yarn is interrupted upon the detection of a corresponding yarn flaw.

Furthermore, an air jet spinning machine is proposed, which features at least one spinning unit with one spinning nozzle for producing a yarn from a fiber composite fed to the spinning nozzle, whereas the spinning nozzle features one inlet for the fiber composite, one internal vortex chamber, one yarn formation element protruding into the vortex chamber along with one outlet for the yarn produced inside the vortex chamber with the assistance of a vortex air flow. The spinning unit includes at least one sensor system, with the assistance of which, during the operation of the spinning unit, the yarn leaving the outlet is monitored with regard to defined yarn flaws, and whereas the spinning unit includes a control unit, which interrupts the production of yarn upon the detection of a corresponding yarn flaw.

BACKGROUND

Air jet spinning machines with corresponding spinning units are known in the state of the art, and serve the purpose of producing a yarn from an elongated fiber composite. Here, the outer fibers of the fiber composite are, with the assistance of a vortex air flow generated by the air nozzles within the vortex chamber in the area of the inlet mouth of the yarn formation element, wound around the internal core fibers, and ultimately form the winding fibers that determine the desired strength of the yarn. This creates a yarn with a genuine twist, which may be ultimately led away through a draw-off channel from the vortex chamber, and wound up, for example, on a sleeve.

In general, within the meaning of the invention, the term "yarn" is understood to be a fiber composite, for which at least one part of the fibers is wound around an internal core. Thus, this comprises a yarn in the conventional sense, which may be processed into a fabric, for example with the assistance of a weaving machine. However, the invention also relates to air jet spinning machines, with the assistance of which so-called "roving" (another name: coarse roving) may be produced. This type of yarn is characterized by the fact that, despite a certain strength, which is sufficient to transport the yarn to a subsequent textile machine, it is still capable of drafting. Thus, the roving may be drafted with the assistance of a drafting device, for example the drafting system, of a textile machine processing the roving, for example a ring spinning machine, before it is ultimately spun.

In the production of a yarn from synthetic fibers, such as polyester, or mixtures of natural and synthetic fibers, deposits on the surface of the yarn formation element arise. The production of synthetic fibers comprises a so-called "preparation of continuous fibers" during the production process. Preparation agents, usually oils with various additives, are applied at the continuous fibers; this enables a treatment such as, for example, drafting the continuous fibers at high speeds. Such preparation agents sometimes adhere to the synthetic fibers even during the further treatment, and lead to impurities in the air jet spinning machine. The fibers fed to the air jet spinning machine in the form of a fiber composite are typically fed by a pair of delivery rollers of the spinning nozzle. The pair of delivery rollers may match a pair of output rollers of a drafting system. The drafting system that is used serves the purpose of the refinement of the advanced fiber composite prior to entering the spinning nozzle.

Typically, a fiber guide element is arranged in the entrance area of the spinning nozzle; through this, the fiber composite is led into the spinning nozzle and finally in the area of the yarn formation element. As yarn formation elements, the majority of spinning units are used with an internal draw-off channel. At the top of the yarn formation element, compressed air is introduced through the housing wall of the spinning nozzle in such a manner that the specified rotating vortex air flow arises. As a result, individual external fibers are separated from the fiber composite leaving the fiber guide element and are turned over through the top of the yarn formation element. In the further process, these removed fibers rotate on the surface of the yarn formation element. Following this, through the forward movement of the internal core fibers of the fiber composite, the rotating fibers are wound around the core fibers and thereby form the yarn. However, through the movement of the individual fibers over the surface of the yarn formation element, deposits also form on the yarn formation element because of adhesions on the fibers from the production process. For the same reasons, deposits may also occur on the surface of the interior of the spinning nozzle or the fiber guide element. These adhesions lead to deterioration of the surface condition of the yarn formation element, and cause a deterioration in the quality of produced yarn. Therefore, the regular cleaning of the affected surfaces is necessary in order to maintain the consistent quality of the spun yarns.

The surfaces of the yarn formation element, the interior of the spinning nozzle and the fiber guide element may be cleaned manually through a periodic disassembly of the yarn formation element, but this leads to a substantial maintenance effort, coupled with a corresponding interruption in operations.

By contrast, EP 2 450 478 discloses a device that enables an automatic cleaning without stopping the machine. For this purpose, during a cleaning process, an additive is mixed with the compressed air used for the formation of the vortex air flow within the spinning nozzle. The additive is guided through the compressed air on the yarn formation element, and results in the cleaning of the surface of the yarn formation element.

However, with the solution specified above, it is disadvantageous that the yarn provided with the additive during the cleaning process generally does not correspond to the quality requirements, since the yarn properties are negatively affected by the quantity of additive (which is not insignificant) along with the absorbed impurities.

SUMMARY OF THE INVENTION

A task of the present invention is to propose a method along with a corresponding air jet spinning machine for carrying out this method, which takes the disadvantage of the prior system and method into account. Additional objects and advantages of the invention will be set forth in part in the following description, or may be obvious from the description, or may be learned through practice of the invention.

The objects are solved by a method and an air jet spinning machine with the characteristics described and claimed herein.

In accordance with the invention, the method for operating an air jet spinning machine is initially characterized by the fact that the yarn leaving the outlet of the spinning nozzle is monitored with regard to defined yarn flaws with the assistance of at least one sensor system, and that the production of the yarn is interrupted upon the detection of a corresponding yarn flaw.

The yarn leaving the spinning nozzle is monitored for quality with the assistance of the sensor system during the normal operation of the spinning nozzle, whereas the sensor system may include one or more sensors known from the state of the art that monitor the yarn, for example, in optical or capacitive terms. In particular, it is advantageous if the yarn is monitored in terms of its thickness, mass, hairiness or other quality of the properties that characterize yarn, whereas the invention is not limited to the monitoring of particular physical properties of the yarn.

In any case, the control of the air jet spinning machine is designed to monitor the measured values of the sensor system on the basis of predefined target values and/or corresponding limits. If the control determines that the values measured by the sensor system deviate from the corresponding guidelines (that is, that the yarn has a yarn flaw), which make the yarn unusable for further processing, the spinning nozzle is shut down. After the shut-down, the yarn section featuring the yarn flaw is separated from the remaining yarn section that is already on the coil ("clearer cut"), and the newly created yarn ends are connected with the fiber composite that is once again fed to the spinning nozzle, in order to resume the normal operation of the spinning nozzle (the so-called "piecing process").

In accordance with the invention, it is provided that, between the detection of the specified yarn flaw (which may comprise, for example, a local thick part or a longer yarn section with an excessively increased or decreased length-related mass or thickness) and the interruption of yarn production (that is, the shut-down of the spinning nozzle), a cleaning process is carried out at least from time to time, during which an additive is fed to the spinning unit and is applied to the fiber composite and/or the yarn produced from the fiber composite and/or on parts of the spinning nozzle.

Thus, the production of yarn is not immediately interrupted after detecting the yarn flaw, as this is common in the state of the art, in order to minimize the length of the yarn flaw after detection (after the interruption, this must be separated again from the yarn section produced before the yarn flaw and disposed of). Rather, the production of yarn continues for a certain period of time after recognizing the yarn flaw.

During this period, as part of the cleaning process, the yarn produced by the spinning nozzle in this period of time and/or the fiber composite fed to the spinning unit for the production of the same is wetted with an additive. Upon the passing of the yarn provided with additive or the corresponding fiber composite through the area of the spinning nozzle following the addition of the additive, this is finally cleaned by the mechanical contact between the yarn or fiber composite and the corresponding surface sections of the spinning nozzle. In particular, the cleaning of the outer surface of the yarn formation element, the draw-off channel and possibly the section of the yard guide element that comes into contact with the fiber composite thereby takes place, whereas the additive significantly supports the cleaning.

Incidentally, fluid or even solid substances (or mixtures thereof) may be used as the additive, whereas water or an aqueous solution (such as a cleaning solution) is preferential.

The method in accordance with the invention has the decisive advantage that the additive (which is in the quantity added in the cleaning process) is not desired in the finished yarn, but is applied to a section of the yarn (or the fiber composite fed to its production) that passes the spinning nozzle after the detected yarn flaw. Consequently, within the framework of the subsequent clearer cut, the yarn section featuring the additive and impurities, together with the yarn flaw, are separated from the remaining yarn section that corresponds to the quality requirements. As a result, the yarn coil that is finished (that is, leaving the air jet spinning machine) is thus not only free of yarn flaws, but is also free of yarn sections that leave the spinning nozzle during the cleaning process and are provided with an excessive quantity of additive, or in particular with impurities removed from the respective surface sections of the spinning nozzle.

In addition, the cleaning process can be carried out after every detection of a correspondingly relevant yarn flaw. It is also conceivable that the cleaning process is carried out according to certain requirements from time to time, that is, not upon each clearer cut.

It is also advantageous if the sensor system is deactivated during the cleaning process and/or the evaluation of the measured values delivered by the sensor system is interrupted during the specified period of time. The reason for this is that the yarn leaving the spinning nozzle during the cleaning process is provided with additive and impurities. If, during this time period, the sensor system delivered additional measured values concerning yarn quality to the control unit, or if the control unit evaluated such measured value as it would during the normal operation of the air jet spinning machine, this would have the consequence that, during the cleaning process, yarn flaws would be continuously reported, which would always entail a new clearer cut or a new cleaning process. Since it is also the case that, during the cleaning process, yarn quality no longer plays a role, the monitoring of the same in such period of time can be dispensed with.

It is also advantageous if, on the basis of the measured values delivered by the sensor system during the cleaning process, a qualitative and/or quantitative monitoring of the additive feed takes place. It can thereby be ensured that the yarn leaving the spinning nozzle during the cleaning process is also actually provided with additive. Since this is crucial for the desired cleaning effect within the spinning nozzle, the desired cleaning can be indirectly monitored with the assistance of the sensor system during the cleaning process. For example, it is conceivable to monitor the hairiness of the yarn, since, when compared to normal operation, a low degree of hairiness in the yarn indicates that the yarn (or the corresponding fiber composite) has been brought into contact with additive, which brings about a "laying alongside" of the fiber ends determining the hairiness on the remaining yarn body. It would also be possible to insert one or more capacitive sensors of the sensor system in order to detect the length-related mass or the corresponding mass fluctuations of yarn. Since the specified sensors in particular respond to water or aqueous liquids, in this manner, the quantity of additive related to the yarn length during the cleaning process, and thus the proper functioning of the additive delivery, can be monitored during this period of time.

As indicated above, it is particularly advantageous if, after the interruption of the yarn production, with the assistance of a yarn removal unit, the yarn section containing the yarn flaw is, together with the yarn section produced during the cleaning operation, removed from the remaining yarn produced prior to the detection of the corresponding yarn flaw. This can take place, for example, with the assistance of a yarn removal unit, which draws in the existing yarn end after the interruption of the yarn production (that is, after the conclusion of the cleaning process). If the coil featuring the remaining yarn section (which includes the yarn flaw and the yarn section produced during the cleaning process) is driven in reverse, the yarn reels off the coil somewhat and enters the yarn removal unit. As soon as the required quantity of yarn (that is, the yarn section featuring the yarn flaw) is removed from this, the yarn can be severed. This creates a new end section of the yarn freed from the yarn flaw, which can be subsequently guided through the spinning nozzle against the transport direction within the framework of a piecing process, brought into contact with the fiber composite and subsequently introduced into the spinning nozzle in the transport direction together with the fiber composite, in order to finally resume the normal operation of the air jet spinning machine or the spinning unit featuring the corresponding spinning nozzle (the air jet spinning machine may, of course, feature a multitude of spinning units, each of which features a spinning nozzle and a sensor system and at which individual corresponding cleaning processes can be carried out).

It is also advantageous if the yarn delivery speed of the spinning nozzle during the cleaning process is less than the yarn delivery speed that prevails during a normal operation of the spinning nozzle preceding the detection of the yarn flaw. Thereby, on the one hand, the length of yarn produced during the cleaning process is minimized, such that, after the cleaning process, even less yarn needs to be removed from the remaining yarn. In addition, the cleaning effect can be improved. The delivery speed during the cleaning process can be throttled abruptly or gradually, compared to the prevailing delivery speed during normal operation, whereas the delivery speed during the cleaning process could amount to between 50 m/min and 300 m/min (however, the corresponding value during normal operation is preferably over 400 m/min).

It is particularly advantageous if, during the cleaning process, a yarn is produced, the length-related mass of which is greater than the length-related mass of the yarn that is produced during a normal operation of the spinning nozzle preceding the detection of the yarn flaw. In this case, the corresponding yarn has a greater yarn thickness, such that the yarn surface that comes into contact with the corresponding surface sections of the spinning nozzle for the purpose of its cleaning is particularly large. Thereby, the cleaning effect can be significantly improved.

In this connection, it is advantageous if the length-related mass of the yarn produced during the cleaning process features an amount that is less than 30 Nm, preferentially less than 20 Nm, in particular preferentially less than 15 Nm (whereas 1 Nm corresponds to one gram per 10 meters of yarn). However, the length-related mass during normal operation amounts to, for example, 50 Nm to 200 Nm.

It is particularly advantageous if a cleaning process is carried out at defined points in time, even if there is no yarn flaw that leads to an interruption of the yarn production in accordance with previous description. In other words, a cleaning process could be initiated by the control unit or manually if the yarn corresponds to the quality requirements, such that it would actually be the case that a quality-related clearer cut would not be necessary to ensure that the spinning nozzle is regularly cleaned. If such a cleaning process is initiated, it is also advantageous if the yarn section produced during the cleaning process is removed from the remaining yarn after the conclusion of the cleaning process, and the aforementioned piecing process is subsequently carried out (this prevents the yarn section produced during the cleaning process, which is provided with the corresponding impurities, from being located on the finished yarn coil leaving the respective spinning unit).

It is particularly advantageous if the cleaning process is only carried out if, since the last cleaning process, at least one predefined period of time has elapsed, or a predefined minimum length or minimum quantity of yarn has been produced. This prevents the excessively frequent cleaning of the spinning nozzle. It can be quite advantageous if individual yarn flaws are removed by means of the aforementioned "clearer cut," and a piecing process is subsequently carried out, without carrying out a cleaning process in this connection.

It is also advantageous if the volume flow of fed additive features, at least temporarily, an amount between 0.001 ml/min and 7.0 ml/min, preferentially between 0.02 ml/min with 5.0 ml/min, in particular preferentially between 0.05 and 3.0 ml/min, and/or if the mass flow of the fed additive features, at least temporarily, an amount between 0.001 g/min and 7.0 g/min, preferentially between 0.02 g/min and 5.0 g/min, in particular preferentially between 0.05 g/min and 3.0 g/min. While higher values are advantageous during the cleaning process (for example, at least 2 ml/min or 2 g/min, as the case may be), smaller values are advantageous in normal operation, in which the additive serves the sole purpose of improving the yarn properties.

The air jet spinning machine according to the invention is finally characterized by the fact that it includes at least one control unit, which is configured to initiate a cleaning process between the detection of the aforementioned yarn flaw and the interruption of the yarn production, during which an additive is fed to the spinning unit with the assistance of an additive supply and is herein applied to the fiber composite and/or the yarn produced from the fiber composite and/or on parts of the spinning nozzle. With respect to the possible advantageous arrangements of the cleaning process or advantageous additional forms of the process steps initiated by the control unit, reference is made to the previous or following descriptions. In general, it must be pointed out at this point that the control unit can be configured to operate the air jet spinning machine in accordance with the separately described characteristics of the method, whereas this may be realized individually or in any combination.

BRIEF DESCRIPTION OF THE DRAWINGS

Additional advantages of the invention are described in the following embodiments. This following is shown, in each case schematically.

DETAILED DESCRIPTION

Figure 1:
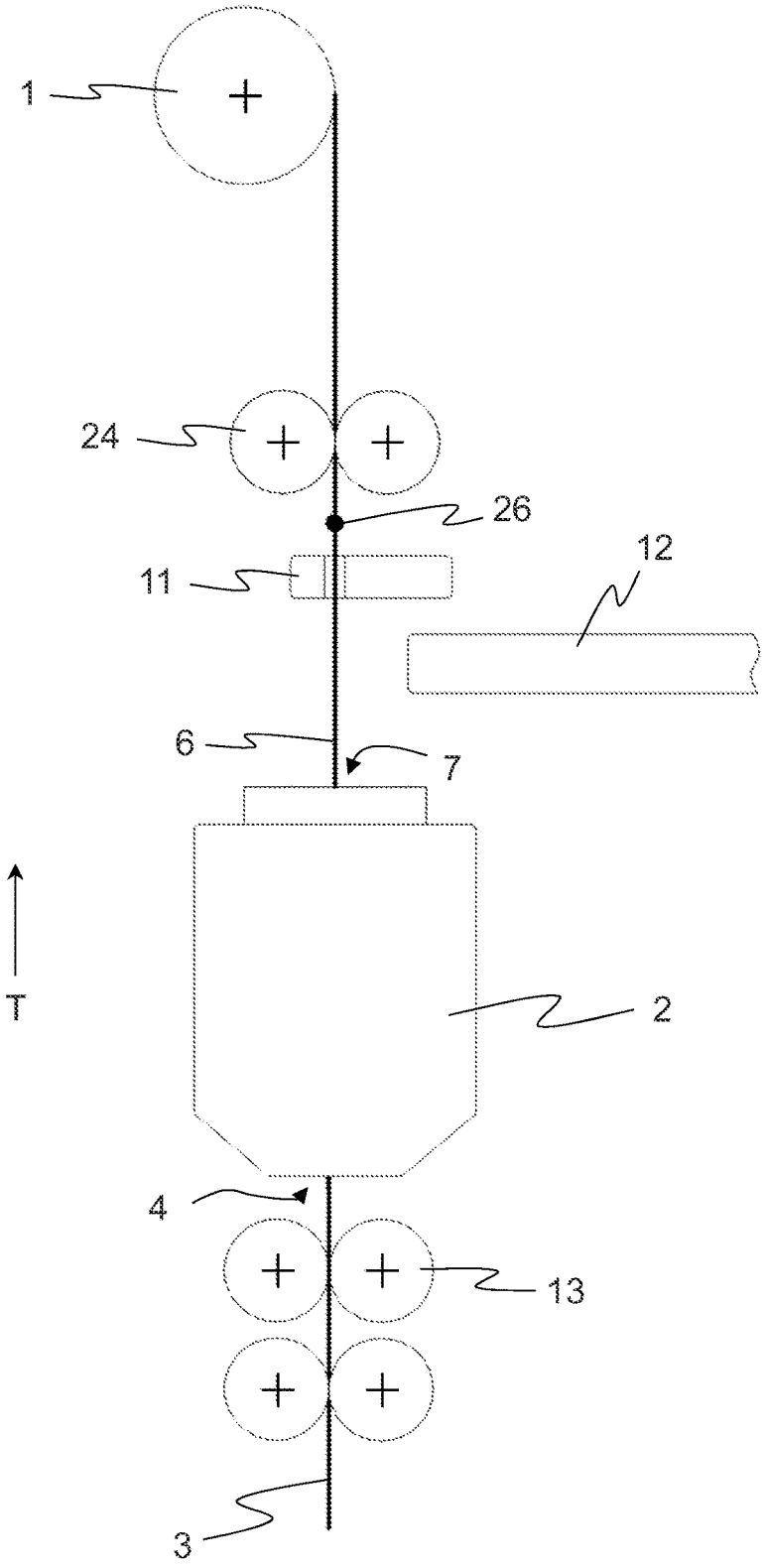
FIG. 1 is a side view of a spinning unit of an air jet spinning machine in accordance with the invention during normal operation.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a cut-out of a spinning unit of an air jet spinning machine in accordance with the invention (whereas the air jet spinning machine may, of course, feature a multitude of spinning units, preferably arranged in a manner adjacent to each other). When required, the air jet spinning machine may include a drafting system with several drafting system rollers 13, which is supplied with a fiber composite 3 in the form of, for example, a doubled sliver (for reasons of transparency, only one of the drafting system rollers 13 that is shown is provided with a reference sign). Furthermore, the spinning unit shown includes a spinning nozzle 2 with an internal vortex chamber 5 (see FIG. 2), in which the fiber composite 3 or at least a part of the fibers of the fiber composite 3 is, after passing an inlet 4 of the spinning nozzle 2, provided with a twist (the exact mode of action of the spinning unit is described in more detail below).

Moreover, the air jet spinning machine may include a pair of draw-off rollers 24 downstream of the spinning nozzle 2, along with a spooling device 1 downstream of the pair of draw-off rollers 24 for the winding of the yarn 6 leaving the spinning nozzle 2 on a sleeve. The spinning unit needs not necessarily feature a drafting system. The pair of draw-off rollers 24 is also not absolutely necessary.

Generally, the spinning unit shown works according to an air jet spinning process. For the formation of the yarn 6, the fiber composite 3 is led into the vortex chamber 5 of the spinning nozzle 2, in a predetermined transport direction T, through a fiber guide element 23, which is provided with an inlet opening forming the specified inlet 4 and shown in FIG. 2. At that point, it receives a twist; that is, at least a part of the free fiber ends 10 of the fiber composite 3 (see FIG. 4) is captured by a vortex air flow that is generated by air nozzles 19 correspondingly arranged in a vortex chamber wall surrounding the vortex chamber 5 (the air nozzles 19 are preferably provided with compressed air through an air supply line 18, which leads into an air supply chamber 17 connected to the air nozzles 19). Thereby, a part of the fibers is pulled out of the fiber composite 3 at least to some extent, and wound around the top of the yarn formation element 21 protruding into the vortex chamber 5. Given that the fiber composite 3 is drawn off through an inlet mouth of the yarn formation element 21 via a draw-off channel 20 arranged within the yarn formation element 21, out of the vortex chamber 5, and finally through an outlet 7 out of the spinning nozzle 2, the free fiber ends 10 are also ultimately drawn in the direction of the inlet mouth and thereby, as so-called "winding fibers," loop around the core fibers running in the center—resulting in a yarn 6 featuring the desired twist. The compressed air introduced through the air nozzles 19 leaves the spinning nozzle 2 ultimately through the draw-off channel 20 along with an air outlet 25 that might be present, which, when required, may be connected to a vacuum power source.

In general, it must be clarified at this point that the produced yarn 6 generally comprises any fiber composite 3, which is characterized by the fact that an external part of the fibers (so-called "winding fibers") is looped around an internal part of the fibers that is preferably untwisted or, where required, twisted, in order to impart the desired strength to the yarn 6.

Furthermore, the spinning unit is allocated with an additive supply 8, which includes one or more additive reservoirs 15 along with one or more additive supply lines 14, which are preferably at least partially flexible, through which the respective additive reservoir 15 is in fluid connection with an additive delivery 22 arranged in the area of the fiber guide element 23 or within the spinning nozzle 2 (with regard to possible additives 9, reference is made to the prior description).

Figure 2:
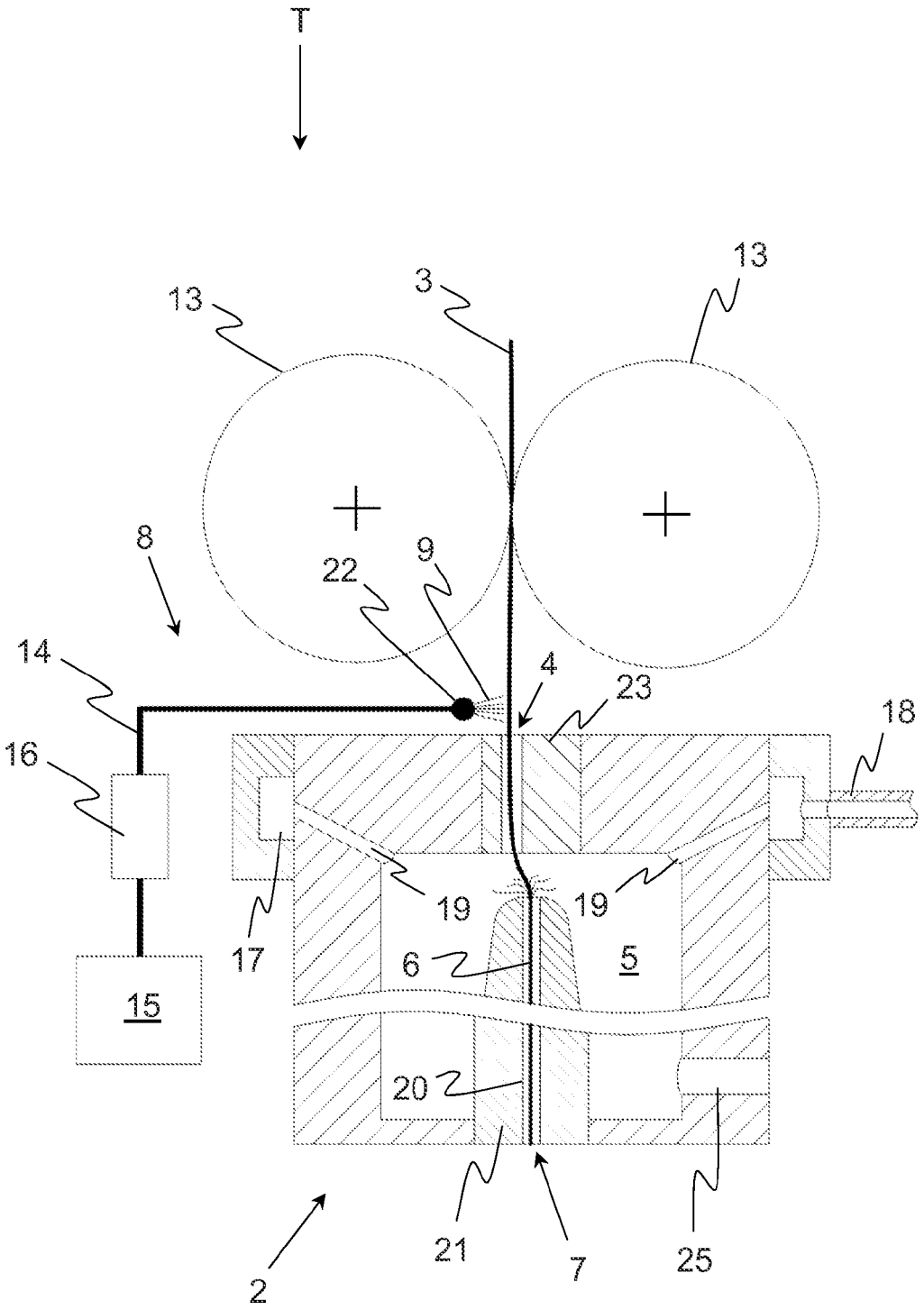
FIG. 2 is a partially cut cut-out of a spinning unit of an air jet spinning machine in accordance with the invention.

In principle, the additive 9 can be delivered to a different place. While FIG. 2 shows an embodiment with which the additive delivery 22 is located in the area of the inlet 4 of the spinning nozzle 2 (such that the additive 9 can be applied to the fiber composite 3), the additive 9 can also be added to the compressed air introduced through the air nozzles 19. Thereby, the entry of the additive 9 takes place, for example, through the air supply line 18 or the specified air supply chamber 17, which runs, for example, in a ring form around the wall bounding the vortex chamber 5 and through which the air nozzles 19 are supplied with compressed air. Finally, it is also possible to introduce the additive 9 through the draw-off channel 20.

In order to deliver the additive 9 through the additive delivery 22 in a manner that is precise and highly reproducible, and also to adjust the delivered volume flow or mass flow of the additive 9 to the respective circumstances, the additive supply 8 also includes at least one dispensing unit 16, which is preferably integrated into the corresponding additive supply line 14, and additive 9 thus flows through it.

In principle, it would be possible to apply the additive 9 in predefined time intervals to the yarn 6 and/or the fiber composite 3, in order to clean the spinning unit on the inside through the contact between the fiber composite 3 or the yarn 6 and the surface sections of individual areas of the spinning nozzle 2 coming into contact with it.

Figure 3:
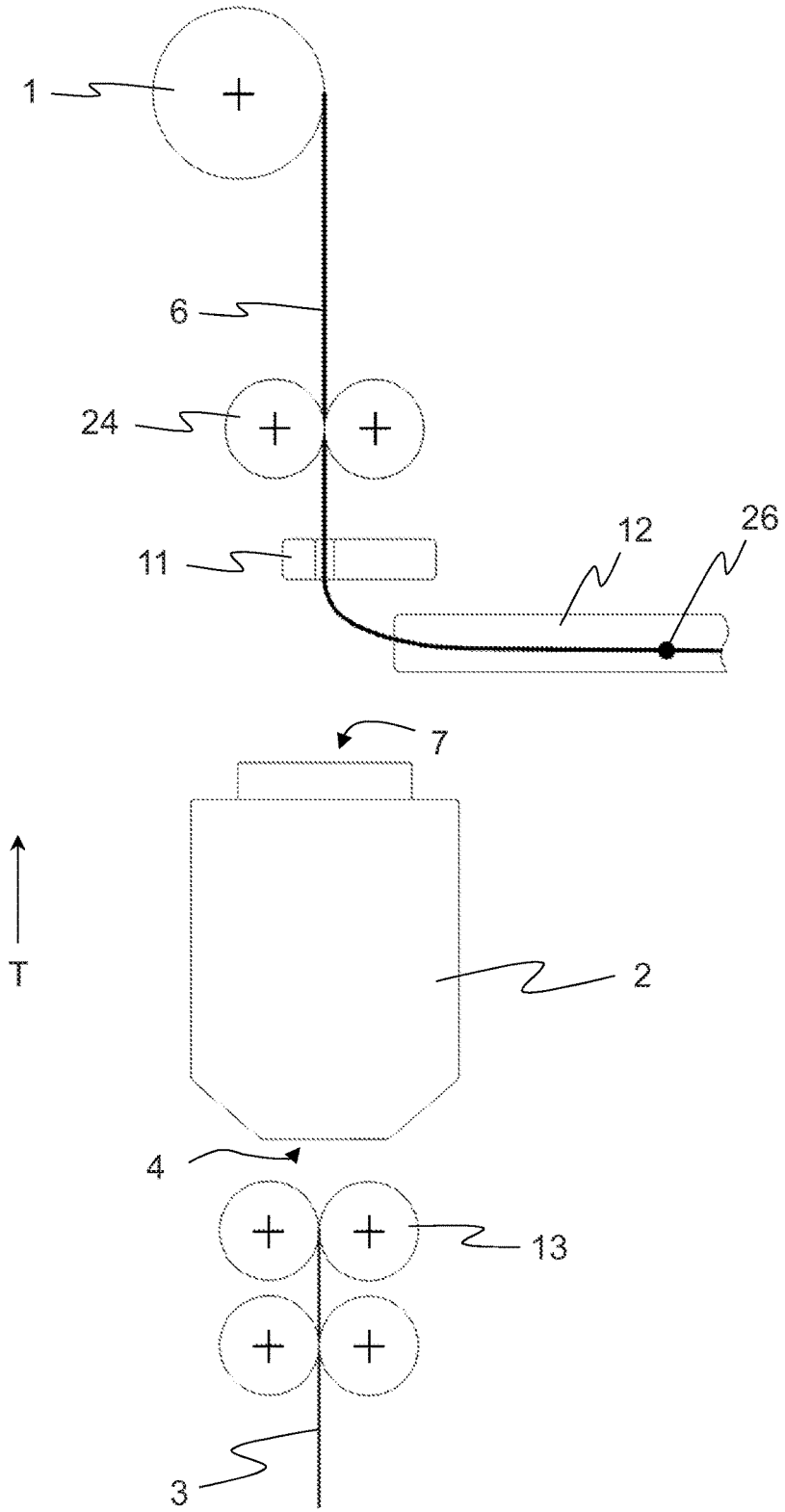
FIG. 3 is the view of FIG. 1 after the conclusion of a cleaning process.

However, within the framework of the present invention, it is proposed that additive 9, or additive 9 in an increased quantity compared to normal operation, is then applied to the fiber composite 3 and/or the yarn 6 for the purpose of the specified cleaning, if the sensor system shown in FIGS. 1 and 3 (which may include one or more optical and/or capacitive sensors) detects a yarn flaw 26 in the yarn 6, which is formed in such a manner that it cannot be tolerated in the finished yarn coil.

After such a yarn flaw 26 has been detected, it is provided that the production of the yarn 6 is not to be immediately interrupted to carry out a clearer cut. Rather, yarn production is continued, whereas, in order to clean the spinning nozzle 2 at this stage, the quantity of additive compared to normal operation increases. After a certain period of time or after a certain yarn length, the production of yarn is finally interrupted, which results in a yarn end that is located between the outlet 7 of the spinning nozzle 2 and the pair of output rollers 24 or within the spinning nozzle 2.

This yarn end ultimately may be captured by the yarn removal unit 12 (which may include, for example, a suction spout). If the coil of the spooling device 1 rotates in reverse until the yarn section featuring the yarn end is located in the yarn removal unit 12, it is ensured that the yarn flaw 26, and the yarn section produced after the detection of the yarn flaw 26 and thus during the cleaning process, are no longer located on the yarn coil of the spooling device 1. With the assistance of a separation unit, the yarn section located in the yarn removal unit 12 (see FIG. 3) can finally be separated from the remaining yarn 6 and disposed of.

Finally, the new yarn end, created in this manner, of the qualitatively error-free yarn 6 found on the yarn coil is guided through the spinning nozzle 2 against the transport direction T, is brought into contact with the fiber composite 3 and is introduced, together with this, into the vortex chamber 5 in the transport direction T (=piecing process), in order to resume the normal operation of the spinning unit.

Figure 4:
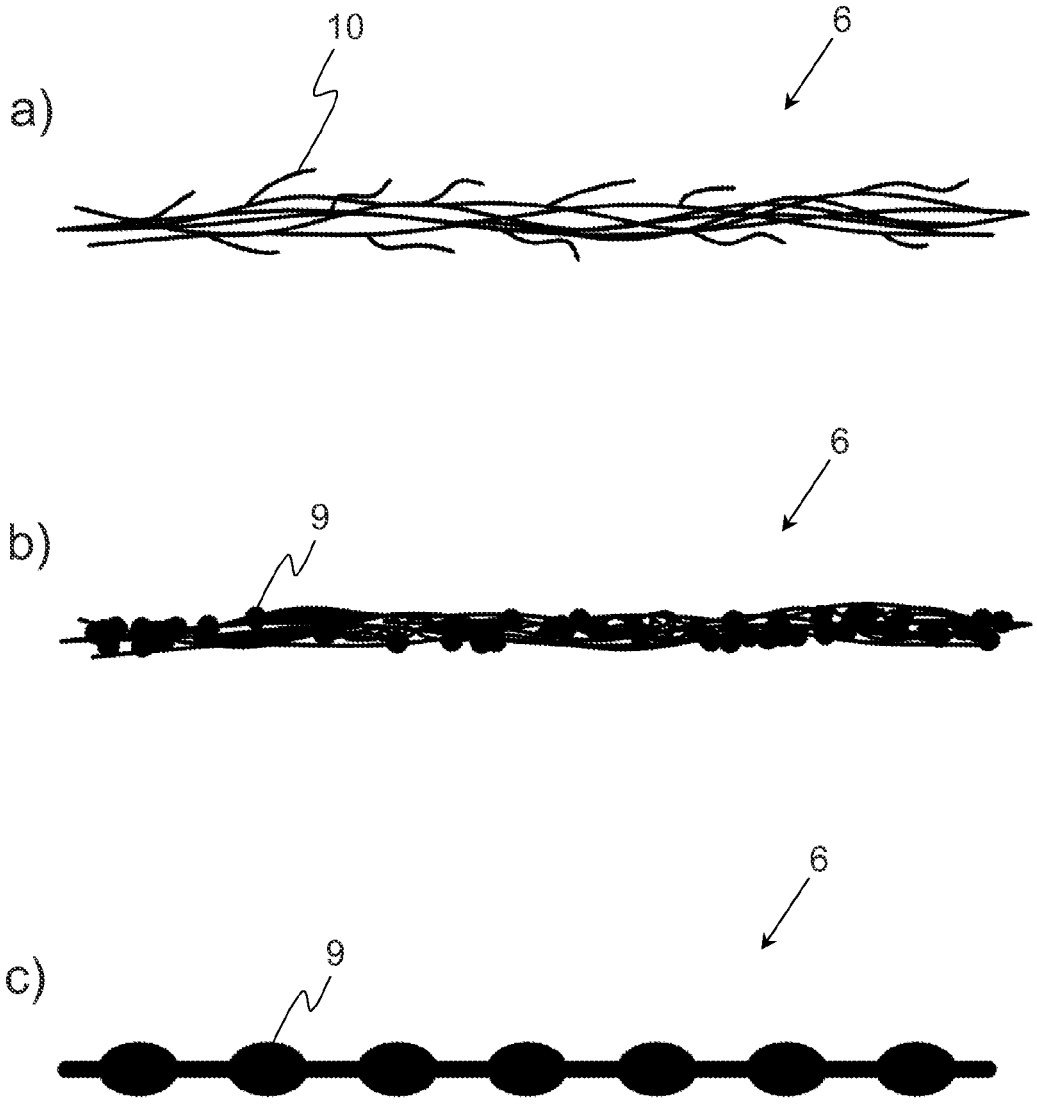
FIG. 4 is various cut-outs of a yarn.

Finally, FIG. 4 shows three yarn sections in a purely schematic manner. As FIG. 4*a*) shows, the yarn produced during normal operation without the addition of additive has a certain degree of hairiness; that is, a part of the free fiber ends 10 is set outwards. However, if the fiber composite 3 or the yarn 6 is wetted with additive 9, at least one part of such fiber ends 10 is laid out on the remaining yarn body (see FIG. 4*b*)), such that the addition of additive can be detected with the assistance of an optical sensor. The mass of the yarn 6 can likewise increase through the addition of additive, such that this can be detected and monitored for quantity with the assistance of a capacitive sensor. FIG. 4 *c*) schematically shows that the additive 9 may also be present in bead form, if the additive 9 is added in a pulse-like manner. In any case, optical and/or capacitive sensors would be suitable for monitoring the addition of additive in terms of quality and/or quantity during normal operation, and in particular during the cleaning process.

The invention is not limited to the illustrated and described embodiments. Variations in the patent claims are possible, such as any combination of the described characteristics, even if they are illustrated and described in different parts of the description or the claims or in different embodiments.

LIST OF REFERENCE SIGNS

1 Spooling device
2 Spinning nozzle
3 Fiber composite
4 Inlet
5 Vortex chamber
6 Yarn
7 Outlet
8 Additive supply
9 Additive
10 Free fiber end
11 Sensor system
12 Yarn removal unit
13 Drafting system roller
14 Additive supply line
15 Additive reservoir
16 Dispensing unit
17 Air supply chamber
18 Air supply line
19 Air nozzle
20 Draw-off channel
21 Yarn formation element
22 Additive delivery
23 Fiber guide element
24 Pair of output rollers
25 Air outlet
26 Yarn flaw
T Transport direction

The invention claimed is:

1. A method for operating an air jet spinning machine having a spinning unit with a spinning nozzle for producing a yarn, the method comprising:

during operation of the spinning unit, feeding a fiber composite to the spinning nozzle through an inlet and in a predefined transport direction, wherein the fiber composite within a vortex chamber of the spinning nozzle receives a twist with the assistance of a vortex air flow, such that a yarn is formed from the fiber composite and leaves the spinning nozzle through an outlet;

monitoring the yarn leaving the outlet with at least one sensor system with regard to defined yarn flaws;

interrupting production of the yarn upon the detection of a corresponding yarn flaw;

between detection of the specified yarn flaw and interruption of the yarn production, performing a cleaning process for a specified period of time during which an additive is fed to a location either within the spinning nozzle or upstream of the spinning nozzle and is applied to one or more of: (1) the fiber composite; (2) the yarn produced from the fiber composite; or (3) parts of the spinning nozzle.

2. The method according to claim 1, wherein the sensor system is deactivated during the cleaning process and evaluation of measured values delivered by the sensor system is interrupted during the specified period of time.

3. The method according to claim 1, wherein on the basis of measured values delivered by the sensor system during the cleaning process, one or both of a qualitative or quantitative monitoring of the additive feed takes place.

4. The method according to claim 1, wherein after the interruption of yarn production, with the assistance of a yarn removal unit, a yarn section containing the yarn flaw and a yarn section produced during the cleaning operation are removed from the yarn, and further comprising performing a subsequent piecing process wherein an end section of the remaining yarn is guided through the spinning nozzle against the transport direction, is brought into contact with the fiber composite and is subsequently introduced into the spinning nozzle in the transport direction together with the fiber composite.

5. The method according to claim 1, wherein a yarn delivery speed of the spinning nozzle during the cleaning process is less than the yarn delivery speed that prevails during a normal operation of the spinning nozzle preceding detection of the yarn flaw.

6. The method according to claim 1, wherein, during the cleaning process, a yarn is produced having a length-related mass that is greater than the length-related mass of the yarn produced during a normal operation of the spinning nozzle preceding detection of the yarn flaw.

7. The method according to claim 6, wherein the length-related mass of the yarn produced during the cleaning process is less than 30 Nm.

8. The method according to claim 1, further comprising performing the cleaning process at defined points in time regardless of detection of a yarn flaw that leads to interruption of yarn production.

9. The method according to claim 1, further comprising performing the cleaning process at one or all of: (1) a defined period of time has elapsed since the last cleaning process; (2)

a predefined minimum length of yarn has been produced; or (3) a predefined minimum quantity of yarn has been produced.

10. The method according to claim 1, wherein a volume fed flow of the additive is between 0.001 ml/min and 7.0 ml/min.

11. Air jet spinning machine, comprising:

a spinning unit with a spinning nozzle for producing a yarn from a fiber composite fed to the spinning nozzle, the spinning nozzle further comprising;

an inlet for the fiber composite;

an internal vortex chamber;

a yarn formation element protruding into the vortex chamber;

an outlet for the yarn produced inside the vortex chamber with assistance of a vortex air flow;

the spinning unit further comprising:

a sensor system configured to monitor the yarn leaving the outlet during the operation of the spinning unit with regard to defined yarn flaws;

a control unit that interrupts production of the yarn upon detection of a corresponding yarn flaw;

an additive supply allocated to the spinning unit and located such that an additive is supplied to a location either within the spinning nozzle or upstream of the spinning nozzle during operation of the spinning unit;

the control unit further configured to initiate a cleaning process between detection of the specified yarn flaw and interruption of yarn production, during which the additive is fed to the spinning unit by the additive supply; and wherein the additive is applied to one or all of (1) the fiber composite; (2) the yarn produced from the fiber composite; or (3) parts of the spinning nozzle.

12. The air jet spinning machine according to claim 11, wherein the control unit is connected to the sensor system and is configured to operate the air jet spinning machine under consideration of measured values transmitted by the sensor system.

* * * * *